United States Patent [19]

Tajima

[11] Patent Number: 4,606,285

[45] Date of Patent: Aug. 19, 1986

[54] LOOPER DRIVING SYSTEM IN AN EMBROIDERY MACHINE

[75] Inventor: Ikuo Tajima, Nagoya, Japan

[73] Assignee: Tokai Kogyo Mishin Kabushiki Kaisha, Kasugai, Japan

[21] Appl. No.: 726,239

[22] Filed: Apr. 23, 1985

[30] Foreign Application Priority Data

May 9, 1984 [JP] Japan ..... 59-93573

[51] Int. Cl.[4] ..... D05C 3/02

[52] U.S. Cl. ..... 112/98

[58] Field of Search ..... 112/98, 99, 201, 220

[56] References Cited

FOREIGN PATENT DOCUMENTS 475768 5/1915 France ..... 112/98

*Primary Examiner*—Wm. Carter Reynolds

*Attorney, Agent, or Firm*—Dennison, Meserole, Pollack & Scheiner

[57] ABSTRACT

A looper driving system in an embroidery machine of the chain stitch type having a looper support frame, a reciprocable needle, and a plurality of loopers for embroidering a cloth in a multicolored pattern. A transmission shaft rotatable about its axis is axially movably mounted to the looper support frame in parallel relation thereto. Gears convert both the axial and rotational movements of the transmission shaft into a single rotational movement of one of the loopers selectively moved to the needle location. Racks and gears rotate the selected one of loopers when the looper is moved to the needle location from a position away from the needle location.

6 Claims, 4 Drawing Figures

LOOPER DRIVING SYSTEM IN AN EMBROIDERY MACHINE

BACKGROUND OF THE INVENTION

1. Field of the Invention

This invention relates to a looper driving system in an embroidery machine of the chain stitch type having a plurality of loopers for embroidering a multicolored pattern on a single piece of cloth.

2. Description of the Prior Art

Embroidery machines having a plurality of loopers for embroidering a cloth in a multicolored pattern using a plurality of threads of different color, are known from the prior art. A known embroidery machine of this type has employed a disk-like table which includes a plurality of loopers mounted thereto in a planetary fashion, the rotation of the table being controlled to displace any desired one of the loopers to the location where the machine needle passes through a cloth to be embroidered. While this prior art machine has generally been successful in perfoming its intended function, it has disadvantageously included a complicated mechanism for positioning any desired one of loopers at the needle location and/or for imparting a rotational movement to the looper at the needle location.

SUMMARY OF THE INVENTION

It is, accordingly, an object of the present invention to provide an improved looper driving system in an embroidery machine which is simple in construction.

It is another object of the present invention to provide such looper driving system which may precisely control the rotation of loopers in an embroidery machine.

According to the present invention, there is provided in an embroidery machine of the chain stitch type having a looper support frame, a reciprocable needle, and a plurality of loopers for embroidering a cloth in a multicolored pattern, a looper driving system comprising a looper case mounted to the looper support frame, the looper case being adapted to support the loopers therein in aligned relation and for rotation about their axes and to move in the direction of alignment of the loopers for selectively positioning one of the loopers at the location where the needle passes the cloth; a transmission shaft rotatable about its axis and axially movably mounted to the looper support frame in parallel relation thereto; a first means for converting both the axial and rotational movements of the transmission shaft into a single rotational movement of one of the loopers selectively moved to the needle location; and a second means for rotating the selected one of loopers when the looper is moved to the needle location from a position away from the needle location.

The present invention will become more fully apparent from the claims and description as it proceeds in connection with the drawings.

DETAILED DESCRIPTION OF THE PREFERRED EMBODIMENT

Figure 1:
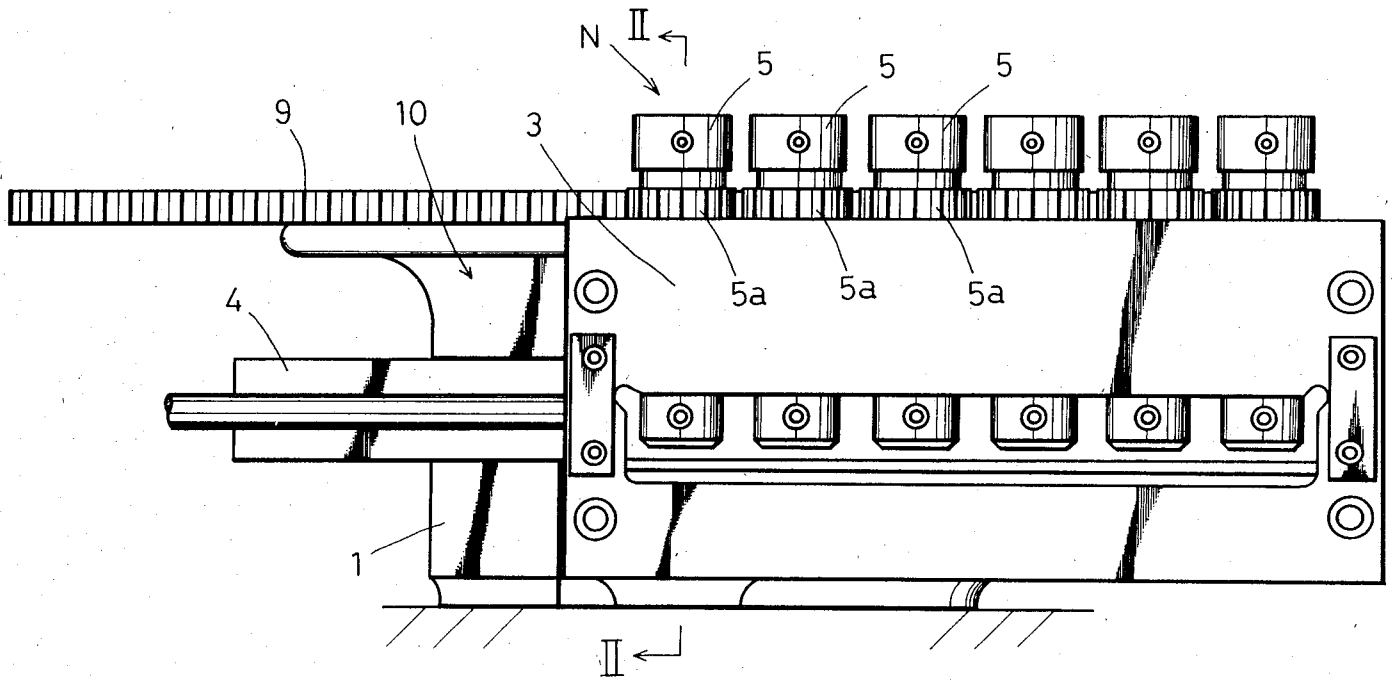
FIG. 1 is a front view showing the several parts of a looper driving system in accordance with the invention.
Figure 2:
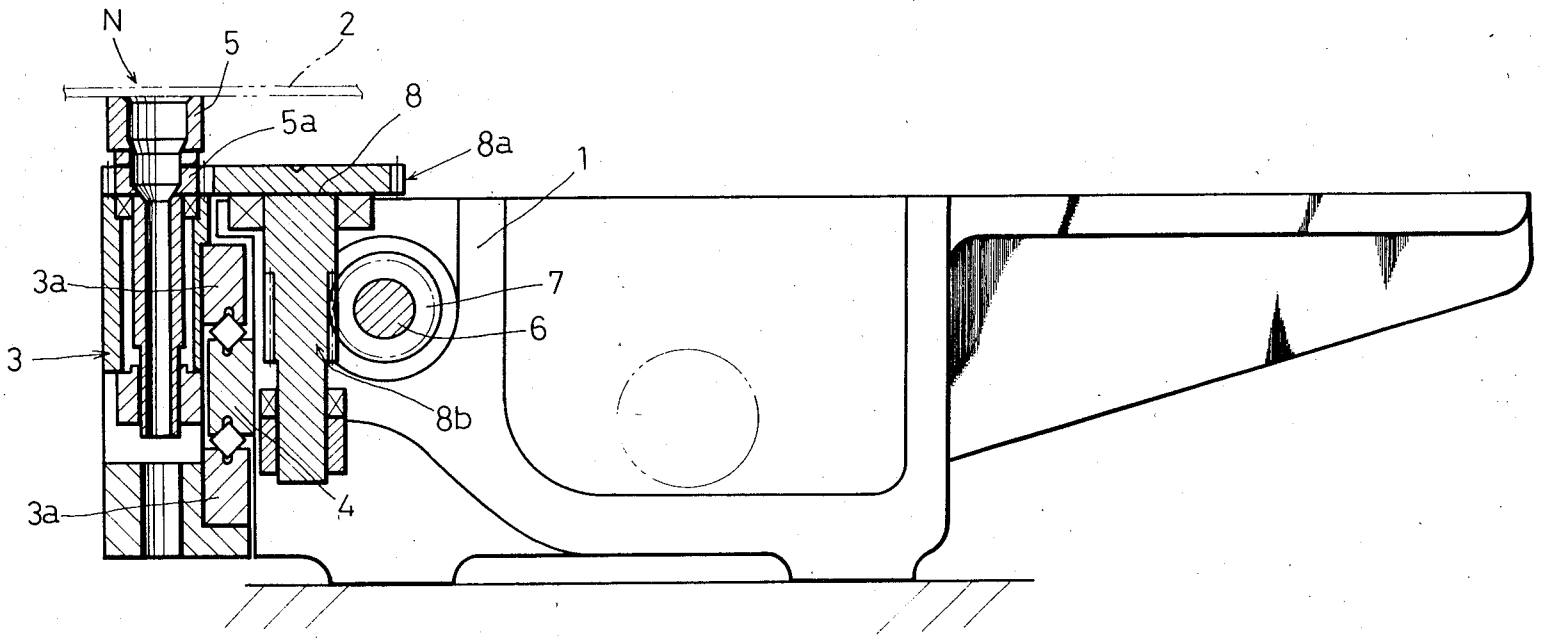
FIG. 2 is a sectional view taken along the line II—II of FIG. 1.
Figure 3:
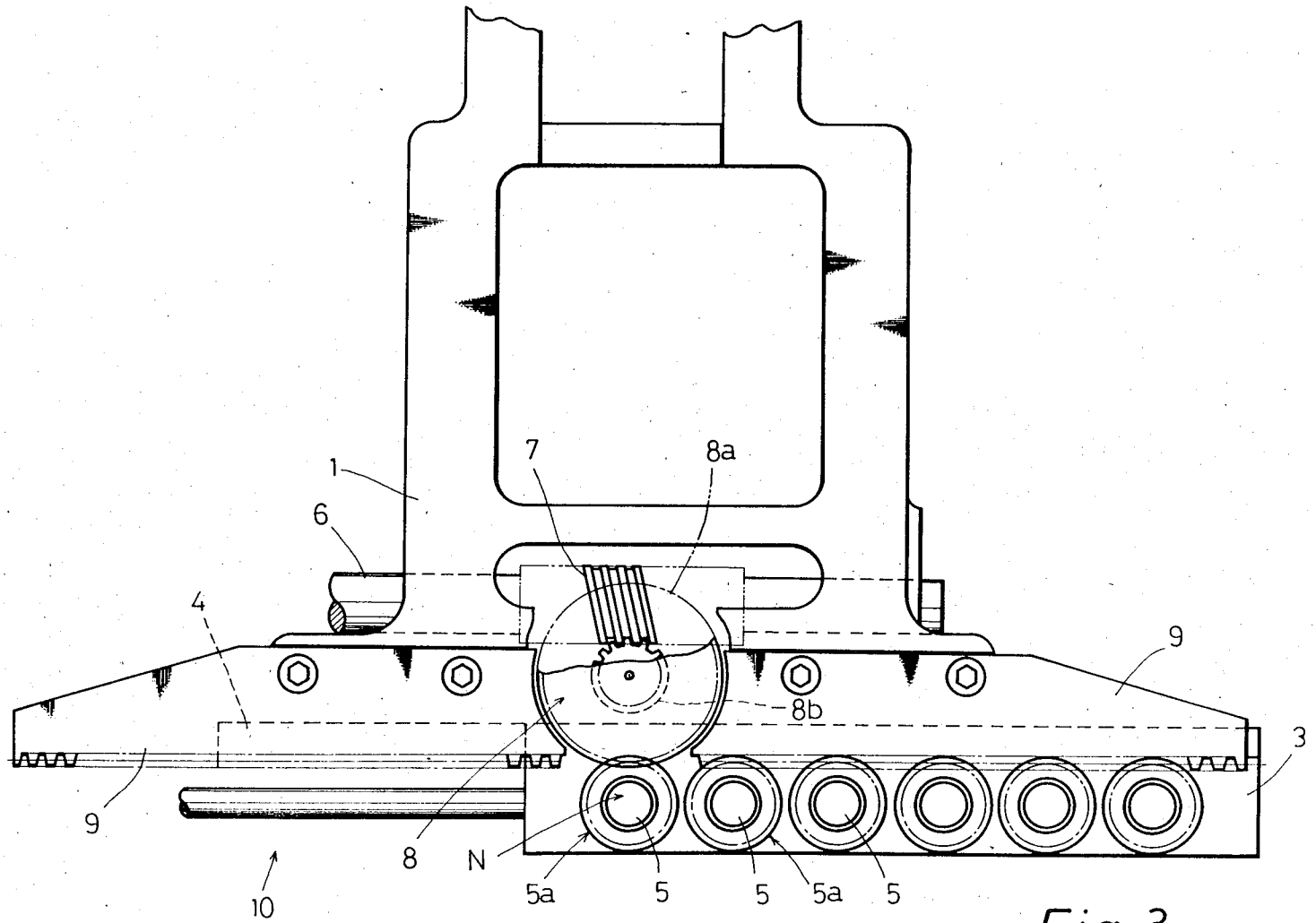
FIG. 3 is a plan view of the embroidery machine shown in FIG. 1.

Referring to the drawings and FIGS. 1 to 3 in particular, shown therein and generally designated by the reference numeral 1 is a looper support frame of an embroidery machine. As shown therein, the looper support frame 1 is disposed generally below a throat plate 2 on which is spread a portion of a cloth surrounding the location N where a machine needle (not shown) passes through the cloth. A looper case 3 is horizontally movably disposed in front of the looper support frame 1. Specifically, the looper case 3 is longitudinally slidable through an upper and a lower slider 3*a* secured thereto which slidably hold a longitudinally extending rail 4 mounted to the front end of the looper support frame 1. The looper case 3 is operatively connected to a cam or other suitable driving mechanism (not shown) which is controlled for rotation in response to thread changeover signals produced from a control unit (not shown) of the embroidery machine.

The looper case 3 includes a plurality of vertically extending loopers 5 (six loopers shown in the drawings) rotatably supported therewithin and arranged in series in equidistant parallel relation for forming an embroidery pattern on a single piece of cloth in association with the needle. Each of the loopers 5 has a spur gear 5*a* formed thereon adjacent the upper end thereof. As the looper case 3 moves, all of the loopers 5 are horizontally moved in unison, and as this occurs, one of the loopers 5 selected by a thread changeover signal is transferred to the location N where the needle passes through the cloth.

Figure 4:
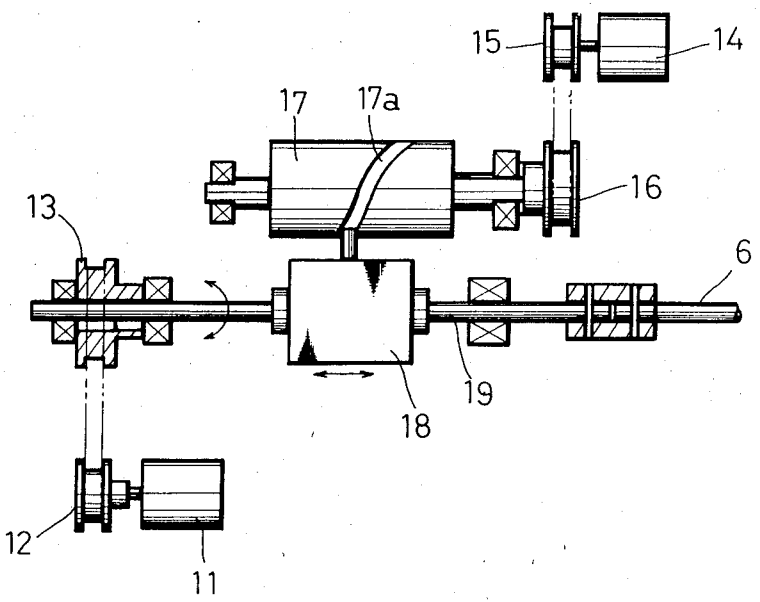
FIG. 4 is a schematic plan view showing the driving mechanism of the transmission shaft.

A horizontally extending transmission shaft 6 is rotatably and axially movably supported on the looper support frame 1. Specifically, as shown in FIG. 4, the transmission shaft 6 is operatively connected to a drive shaft 19 which in turn is operatively connected through pulleys 12 and 13 to a control motor 11 driven in accordance with a cloth transfer signal produced from the control unit. Thus, the transmission shaft 6 is driven for rotation both in forward and reverse directions so as to direct a desired one of the loopers 5 at the needle location N in one direction of movement of the cloth which is intermittently fed in a horizontal plane from the needle in accordance with a pattern to be embroidered. Additionally, a drive motor 14 is provided and is connected through pulleys 15 and 16 to a cam 17 with a cam groove 17*a* engageable with a follower 18 now to be described. This follower is idly but axially non-movably mounted on the drive shaft 19 and adapted to engage the cam groove 17*a* of the cam 17. Thus, as the cam 17 is rotated by the drive motor 14, the drive shaft 19 and hence the transmission shaft 6 are axially moved.

The transmission shaft 6 includes a driving gear 7 in the form of a worm which is operable to convert the axial and the rotational movements of the transmission shaft 6 to a single rotational movement of an intermediate gear 8 which will be explained below.

Rotatably supported by the looper support frame 1 adjacent the looper 5 at the needle location N is an intermediate gear 8 which operatively connects the transmission shaft 6 with the looper 5 at the needle location N. The intermediate gear 8 includes a spur gear-shaped, upper gear portion 8*a* which is engageable with the spur gear 5*a* of the looper 5 and a worm wheelshaped, lower gear portion 8b which is engageable with the worm 7 formed on the drive shaft 6. Thus, the axial and rotational movements of the transmission shaft 6 is converted to a single rotational movement through the meshing engagement of the lower gear portion 8b of the intermediate gear 8 with the worm 7. This rotational movement of the intermediate gear 8 is transmitted to the looper 5 at the needle location N through the gear portion 8a, thereby orienting the looper 5 in the direction of movement of the cloth and at the same time rotating it for forming a stitch.

As best shown in FIG. 3, a pair of racks 9 are mounted to the looper support frame 1 adjacent the opposite sides of the intermediate gear 8 and adapted to mesh the gear 5a of the loopers 5 transferred from the needle location N. The racks 9 extend along a path of movement 10 of the loopers 5 and arranged in spaced relation to provide a space for accommodating the front end of the upper gear portion 8a of the intermediate gear 8. The tooth pitch of the respective racks 9 are determined on the basis of the pitch circle and tooth number of the gear portion 8a of the intermediate gear 8 and of the arrangement pitch of the loopers 5. Thus, the meshing condition may be unitized when the spur gear 5a of the looper 5 removes from the respective rack 9 into meshing engagement with the upper gear portion 8a of the intermediate gear 8, so that the orientation of each of the loopers 5 may be unitized when it is moved from its inoperative position to the needle location N under the thread changeover signal.

In the sewing machine thus constructed, when it is desired to displace any desired one of the loopers 5 to the needle location N, the looper case 3 is moved until the selected looper 5 meshes with the gear portion 8b of the intermediate gear 8. As this occurs, the intermediate gear 8 is rotated a composite rotational angle in response to the axial and rotational movements of the worm 7 on the transmission shaft 6, that is a rotational angle in which the rotational angle of the worm 7 which varies with the direction of feed of the cloth is added to or substracted from the fixed rotational angle representative of the axial movement of the worm 7. Thus, the rotation of the selected looper 5 may be controlled in accordance with the direction of feed of the cloth.

What has been described is a very simple and effective system for driving loopers in an embroidery machine. The system is effective to transmit a composite movement to the looper 5 at the needle location which consists of a first rotational movement to conform to the direction of movement of the cloth and a second rotational movement to form a stitch.

A feature of the system is that it can precisely transmit such a composite movement to the looper 5 at the needle location.

Another feature of the system is that it can be made simple in construction to transmit such a composite movement to the looper 5.

Still another feature of the system is that it can check improper rotational movements of the loopers 5 during thread changeover; as has been mentioned, each of the loopers 5 in its inoperative position is rotated by meshing engagement with the rack 9, and during thread changeover, any selected looper 5 may be transferred precisely and yet smoothly to the needle location N in the same posture at all times so that the driving condition of the selected looper 5 is uniform at the needle location N.

While the invention has been described with reference to a preferred embodiment thereof, it is to be understood that modifications or variations may be easily made without departing from the spirit of this invention which is defined by the appended claims.

What is claimed is:

1. In an embroidery machine of the chain stitch type having a looper support frame, a reciprocable needle and a plurality of loopers for embroidering a cloth in a multicolored pattern, means for driving any desired one of said loopers comprising:

(a) a looper case mounted to said looper support frame, said looper case being adapted to support said loopers therein in aligned relation and for rotation about their axes and to move in the direction of alignment of said loopers for selectively positioning one of said loopers at the location where the needle passes through the cloth;

(b) a transmission shaft rotatable about its axis and axially movably mounted to said looper support frame in parallel relation thereto;

(c) a first means for converting both the axial and rotational movements of said transmission shaft into a single rotational movement of one of said loopers selectively moved to the needle location; and (d) a second means for rotating the selected one of loopers when said looper is moved to the needle location from a position away from the needle location.

2. The invention as defined in claim 1 further comprising a pair of sliders slidably mounted on a rail secured to the front end of said looper support frame, said looper case being fixedly mounted to said sliders.

3. The invention as defined in claim 1 wherein said transmission shaft is rotated by a first motor through a pulley and is axially moved by a second motor through a cam and a follower driven by said cam and idly but axially non-movably carried on said transmission shaft.

4. The invention as defined in claim 1 wherein said first means comprises a worm formed on said transmission shaft, an intermediate gear rotatably supported by said looper support frame and engageable with said worm, and a spur gear formed on said looper and engageable with said intermediate gear, said intermediate gear including a worm wheel engageable with said worm and a spur gear coaxial with said worm wheel and engageable with said spur gear on said looper.

5. The invention as defined in claim 4 wherein said spur gear of said intermediate gear has a greater diameter than said worm wheel.

6. The invention as defined in claim 1 wherein said second means comprises a pair of racks mounted to said looper support frame in diametrically opposed relation to said spur gear of said intermediate gear and engageable with said spur gears of said loopers.

* * * * *